US008545173B2

(12) United States Patent
Valin et al.

(10) Patent No.: US 8,545,173 B2
(45) Date of Patent: Oct. 1, 2013

(54) PROCESS FOR CALIBRATING A VARIABLE-NOZZLE ASSEMBLY OF A TURBOCHARGER AND A VARIABLE-NOZZLE ASSEMBLY FACILITATING SUCH PROCESS

(75) Inventors: Charles Philippe Valin, Metz (FR); Francis Abel, Thaon les Vosges (FR); Lorrain Sausse, Charmes (FR)

(73) Assignee: Honeywell International, Inc., Morristown, NJ (US)

( * ) Notice: Subject to any disclaimer, the term of this patent is extended or adjusted under 35 U.S.C. 154(b) by 500 days.

(21) Appl. No.: 12/865,324

(22) PCT Filed: Jan. 26, 2009

(86) PCT No.: PCT/US2009/031940

§ 371 (c)(1), (2), (4) Date: Jul. 29, 2010

(87) PCT Pub. No.: WO2009/102546

PCT Pub. Date: Aug. 20, 2009

(65) Prior Publication Data

US 2010/0310359 A1 Dec. 9, 2010

Related U.S. Application Data

(60) Provisional application No. 61/027,935, filed on Feb. 12, 2008.

(51) Int. Cl.
*F04D 29/46* (2006.01)

(52) U.S. Cl.
USPC ..... 415/164

(58) Field of Classification Search
USPC ..... 29/889.22; 415/159, 160, 163, 164, 415/165; 417/407
See application file for complete search history.

(56) References Cited

U.S. PATENT DOCUMENTS

| | | | | |
|---|---|---|---|---|
| 3,636,609 | A * | 1/1972 | Stahl | 269/37 |
| 4,770,603 | A * | 9/1988 | Engels et al. | 415/147 |
| 5,146,752 | A * | 9/1992 | Bruestle | 60/602 |
| 6,659,718 | B2 * | 12/2003 | Jinnai et al. | 415/164 |

FOREIGN PATENT DOCUMENTS

| | | |
|---|---|---|
| DE | 197 31 715 A1 | 1/1998 |
| DE | 100 35 762 A1 | 1/2002 |

(Continued)

OTHER PUBLICATIONS

International Search Report for Application No. PCT/US2009/031940 dated Jun. 3, 2009.

*Primary Examiner* — Edward Look
*Assistant Examiner* — Liam McDowell
(74) *Attorney, Agent, or Firm* — Alston & Bird LLP

(57) ABSTRACT

A process for calibrating a variable-nozzle assembly (200) prior to its installation in a turbocharger. The variable-nozzle assembly facilitating such process is installed in a calibration fixture (20) having internal flowpath contours configured to replicate corresponding internal flowpath contours of a turbocharger into which the variable-nozzle assembly (200) is to be installed. The calibration fixture (20) defines a generally annular chamber (110) in fluid communication with a flow path defined in the variable-nozzle assembly (200), and a fluid supply passage (112) extending into the annular chamber. A fluid is supplied through the fluid supply passage (112), and the fluid then flows through the flow path of the variable-nozzle assembly (200). While the fluid is flowing through the variable-nozzle assembly (200), the vanes (220) are pivoted to set a predetermined flow rate. A stop member (290) is then fixed to the variable-nozzle assembly (200) so that the vanes (220) cannot be pivoted past the position corresponding to the predetermined flow rate.

9 Claims, 3 Drawing Sheets

FOREIGN PATENT DOCUMENTS

| | | | |
|---|---|---|---|
| EP | 0 227 475 | A2 | 7/1987 |
| EP | 1 236 867 | A2 | 9/2002 |
| EP | 1 304 462 | A2 | 4/2003 |
| EP | 1 564 380 | A1 | 8/2005 |
| EP | 1 635 040 | A1 | 3/2006 |
| EP | 1 867 840 | A2 | 12/2007 |
| WO | WO 2007/134787 | A1 | 11/2007 |

* cited by examiner

FIG. 3
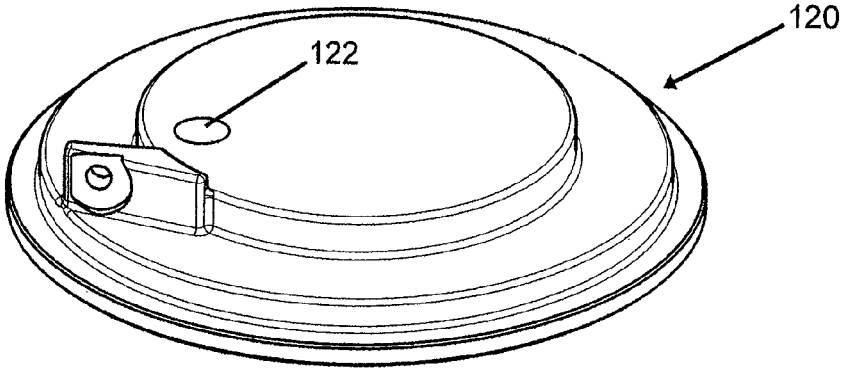
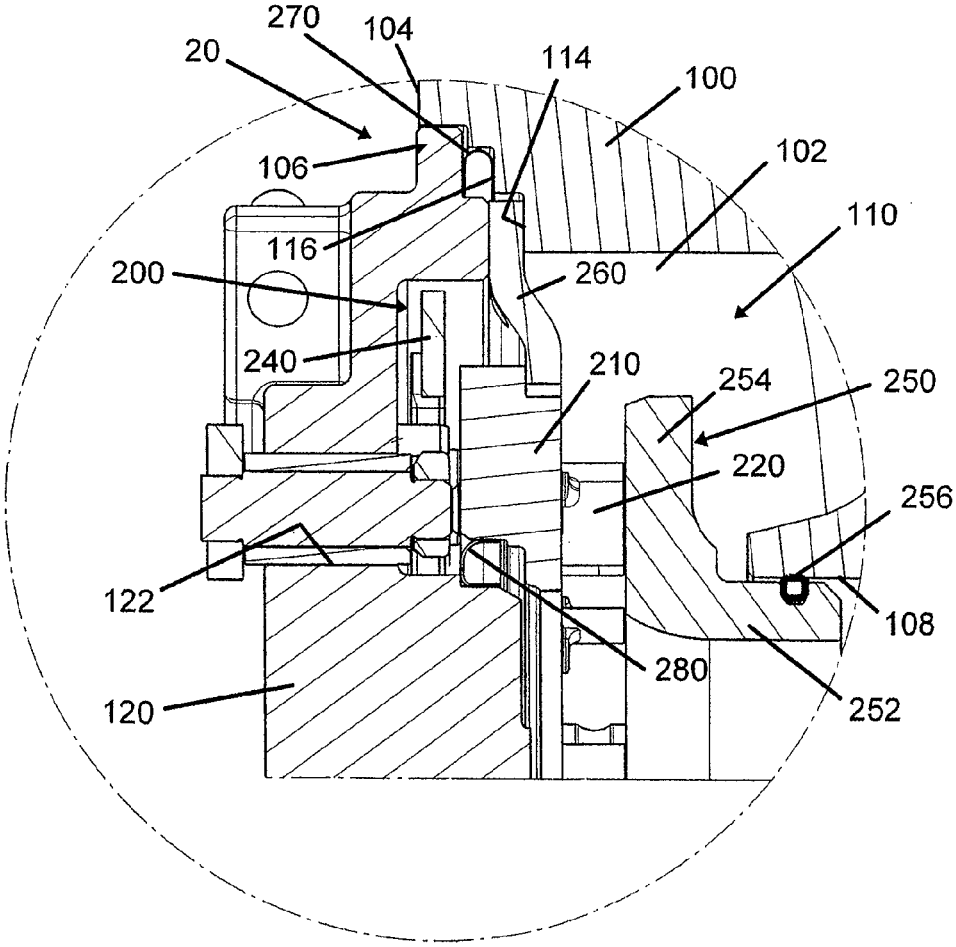
FIG. 4

PROCESS FOR CALIBRATING A VARIABLE-NOZZLE ASSEMBLY OF A TURBOCHARGER AND A VARIABLE-NOZZLE ASSEMBLY FACILITATING SUCH PROCESS

BACKGROUND OF THE INVENTION

The present disclosure relates generally to turbochargers having a variable-nozzle assembly made up of an array of circumferentially spaced vanes supported by a nozzle ring and rotatable about respective axes defined by vane shafts that extend through bearing apertures in the nozzle ring, wherein a unison ring engages vane arms that in turn are affixed to the vane shafts such that rotation of the unison ring in one direction or the other causes the vanes to be pivoted to vary their setting angles, whereby the effective flow area through the nozzle is varied.

Such a variable-nozzle assembly typically is actuated by an actuator (e.g., a diaphragm actuator) connected via a mechanical linkage to the unison ring. The variable-nozzle assembly must be calibrated to ensure that a given position of the mechanical linkage corresponds to the desired positions of the vanes, so that for example when the mechanical linkage is placed in a position that is supposed to produce a minimum flow rate through the nozzle, the vanes will truly be in the proper positions to provide a minimum effective flow area through the nozzle.

This calibration process typically is performed during the assembly of the turbocharger, by installing the variable-nozzle assembly in the turbocharger and then supplying air into the turbine housing so it flows through the variable-nozzle assembly. A pertinent parameter (e.g., turbocharger rotational speed) is monitored while the variable-nozzle assembly is actuated to vary the vane setting angles until the monitored parameter reaches a predetermined level (e.g., until the turbocharger speed reaches a minimum value such that rotating the vanes in either direction from the minimum-speed position causes the speed to increase). Once the desired vane position is attained, the mechanical linkage is adjusted if necessary so that a predetermined position of the linkage produces the desired result.

The need for calibration of the variable-nozzle assembly during the assembly of the turbocharger substantially complicates and slows down the assembly process.

BRIEF SUMMARY OF THE DISCLOSURE

The present disclosure relates to a process for calibrating a variable-nozzle assembly of a turbocharger prior to its incorporation into the turbocharger. The process allows the manufacturer of the variable-nozzle assembly to calibrate the assembly, if desired, before it is shipped to the turbocharger manufacturer who will incorporate it into the turbocharger. In accordance with one embodiment disclosed herein, a process is described for calibrating a variable-nozzle assembly prior to its installation in a turbocharger. The variable-nozzle assembly is installed in a calibration fixture having internal flowpath contours configured to substantially replicate corresponding internal flowpath contours of a turbocharger into which the variable-nozzle assembly is to be installed. The calibration fixture defines a generally annular chamber in fluid communication with a flow path defined in the variable-nozzle assembly, and a fluid supply passage extending into the annular chamber. A fluid is supplied through the fluid supply passage, and the fluid then flows through the flow path of the variable-nozzle assembly. While the fluid is flowing through the variable-nozzle assembly, the vanes are pivoted to set a predetermined flow rate. A stop member can then be affixed to the variable-nozzle assembly so that the vanes cannot be pivoted past the position corresponding to the predetermined flow rate.

In one embodiment, the calibration fixture includes a housing and a cover. The housing defines a central passage extending from a first end at a first face of the housing through to an opposite second end at a second face of the housing, the central passage having a first portion adjacent the first face that is configured to receive the nozzle ring of the variable-nozzle assembly, a second portion sized to receive a tubular part of an insert of the variable-nozzle assembly in a substantially sealed manner, and a third portion forming the generally annular chamber. The cover is configured to engage the housing proximate the first face thereof to substantially close the first end of the central passage.

The process in one embodiment includes steps of: (1) disposing the variable-nozzle assembly in the housing with the tubular part of the insert substantially sealingly received in the second portion of the central passage; (2) connecting a fluid source to the fluid supply passage of the housing and causing a flow of fluid from the fluid source to the fluid supply passage, the fluid then flowing through the flow path defined by the variable-nozzle assembly; and (3) adjusting the setting angles of the vanes while the fluid is flowing through the variable-nozzle assembly to cause the fluid to have a flow rate equal to a predetermined flow rate. The vane arms of the vanes are in a baseline position when the flow rate equals the predetermined flow rate.

In one embodiment the process further comprises the step of affixing a stop member to the nozzle ring. The stop member is structured and arranged to prevent the vane arms from pivoting in one direction past the baseline position, while allowing the vane arms to pivot in an opposite direction away from the baseline position. In a particular embodiment, the stop member is engaged in a receptacle defined in the opposite face of the nozzle ring from the face adjacent the vanes, such that the stop member is rotatable about an axis thereof. The stop member has an eccentric cam positioned to engage one of the vane arms such that rotation of the stop member about its axis in one direction causes the cam to urge the vane arm to pivot about the respective vane shaft's axis, the vane arm in turn causing the unison ring to rotate and thereby pivot the other vane arms in unison. The step of adjusting the setting angles of the vanes comprises rotating the stop member.

The cover in one embodiment includes an opening therethrough aligned with the stop member, and the step of rotating the stop member comprises passing an end of a tool through the opening in the cover and engaging the tool end with the stop member for rotating the stop member.

The process can further comprise the step, following the adjusting step, of fixing the stop member in a substantially permanent manner in the position of the stop member that causes the flow rate to equal the predetermined flow rate. This can be accomplished, for example, by welding the stop member to the nozzle ring, or press-fitting the stop member into the receptacle in the nozzle ring.

In one embodiment, the providing step comprises providing the housing and cover to have internal surfaces guiding the fluid into the variable-nozzle assembly that are configured to substantially conform to corresponding surfaces of the turbocharger into which the variable-nozzle assembly is to be installed.

The present disclosure also provides a variable-nozzle assembly for a turbocharger. The assembly comprises:

a generally annular nozzle ring defining a plurality of circumferentially spaced bearing apertures therethrough;

a plurality of vanes proximate one face of the nozzle ring and each having a vane shaft extending through a respective one of the bearing apertures such that a distal end of each vane shaft is proximate an opposite face of the nozzle ring;

a plurality of vane arms having first ends respectively affixed to the distal ends of the vane shafts and having opposite second ends engaged by a unison ring that is rotatable relative to the nozzle ring about a central longitudinal axis of the variable-nozzle assembly such that rotation of the unison ring causes the vane arms and the vane shafts to pivot about respective axes thereof so as to rotate the vanes to a different setting angle, the variable-nozzle assembly further comprising an insert spaced from the nozzle ring such that the vanes are disposed between the nozzle ring and a portion of the insert, the insert having a tubular part extending along the longitudinal axis for being received in a turbine housing bore of a turbocharger, the variable-nozzle assembly defining a flow path between the nozzle ring and the portion of the insert and through passages between the vanes such that a fluid can flow generally radially inwardly along the flow path and then through the tubular part; and a stop member affixed to the nozzle ring, the stop member being structured and arranged to prevent the vane arms from pivoting in one direction past a baseline position of the vane arms, while allowing the vane arms to pivot in an opposite direction away from the baseline position.

The stop member in one embodiment is engaged in a receptacle defined in the opposite face of the nozzle ring such that the stop member is rotatable about an axis thereof, the stop member having an eccentric cam positioned to engage one of the vane arms such that rotation of the stop member about its axis in one direction causes the cam to urge the vane arm to pivot about the respective vane shaft's axis, the vane arm in turn causing the unison ring to rotate and thereby pivot the other vane arms in unison.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

FIG. 3 is a perspective view toward an outer side of the cover portion;

FIG. 4 is a fragmentary cross-sectional view showing a variable-nozzle assembly installed in the fixture;

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
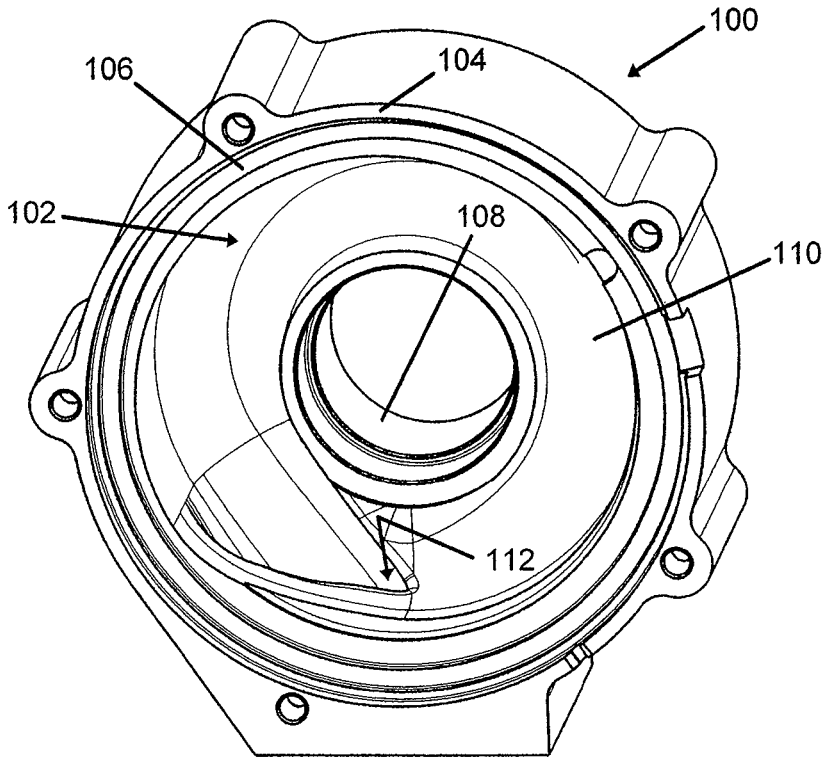
FIG. 1 is a perspective view of a housing portion of a calibration fixture in accordance with one embodiment of the present invention.
Figure 2:
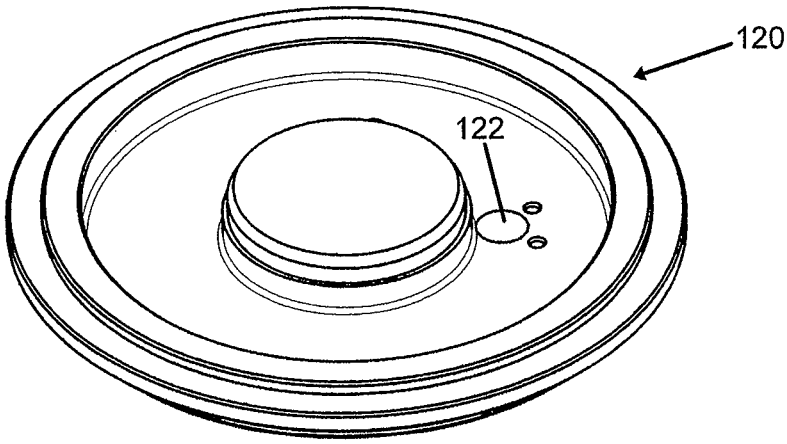
FIG. 2 is a perspective view toward an inner side of a cover portion of the calibration fixture in accordance with one embodiment of the invention.

FIG. 1 shows a housing 100 of a calibration fixture 20 useful in a process for calibrating a variable-nozzle assembly in accordance with one embodiment of the invention. FIGS. 2 and 3 show a cover 120 of the fixture. The housing 100 and cover 120 are designed to replicate the internal flowpath contours of the turbocharger into which the variable-nozzle assembly will be installed. In particular, the housing 100 replicates internal contours of the turbine housing, and the cover 120 replicates internal contours of the center housing of the turbocharger.

The housing 100 defines a central passage 102 extending from one face 104 to an opposite face (not visible in FIG. 1) of the housing. The passage includes a first portion 106 adjacent the face 104, a second portion 108 adjacent the opposite face, and a third portion 110 disposed generally between the first and second portions. The first portion 106 has a relatively large inside diameter and includes stepped regions for purposes described below. The second portion 108 is relatively small in inside diameter compared to the first portion and is sized to receive a tubular part of the variable-nozzle assembly as further described below. The third portion 110 is configured to replicate the annular or toroidal chamber of the turbine housing into which the variable-nozzle assembly will be installed. The third portion has a relatively large diameter compared to the second portion 108. The housing 100 also includes a fluid supply passage 112 that extends through an outer peripheral surface of the housing into the third portion or chamber 110 of the housing, so that fluid (e.g., air) can be supplied via the passage 112 into the chamber 110.

The first portion 106 of the housing passage is configured to receive the variable-nozzle assembly as well as the cover 120, in such a manner that the cover substantially seals the variable-nozzle assembly inside the housing 100 and prevents air supplied through the passage 112 from escaping except by flowing from the chamber 110 inwardly through the vanes of the variable-nozzle assembly and then out through the second portion 108 of the housing passage.

Figure 5:
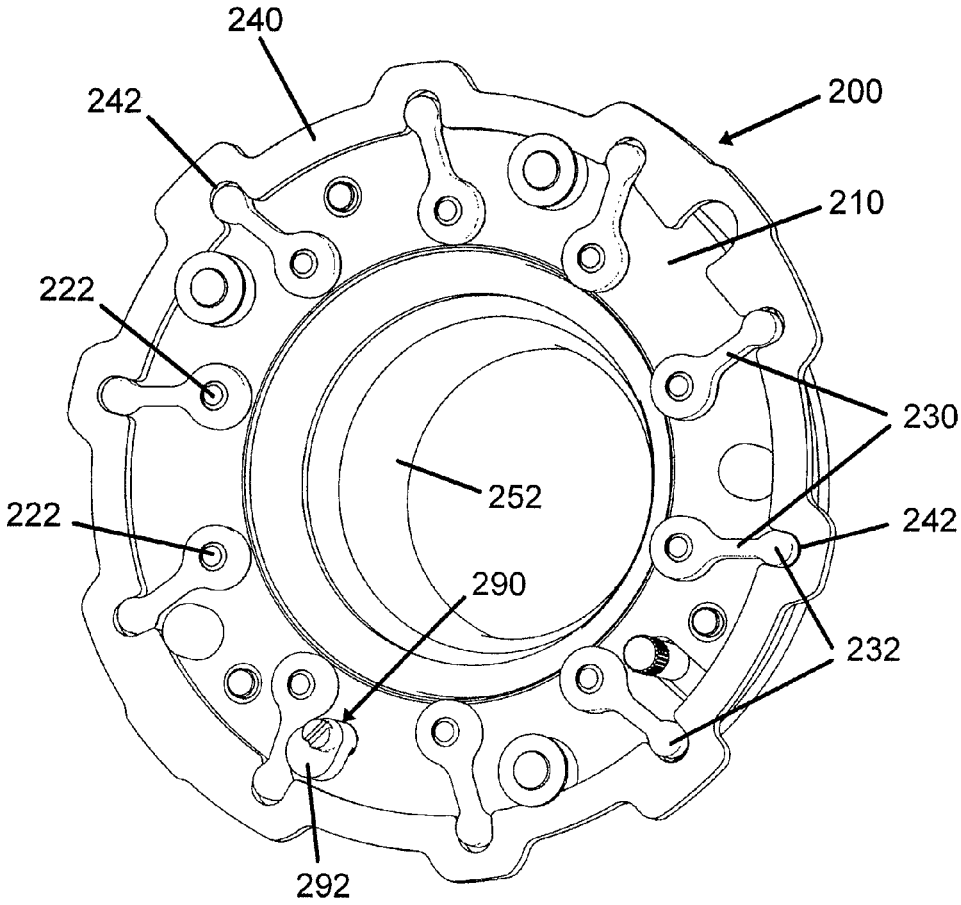
FIG. 5 is a perspective view of a variable-nozzle assembly in accordance with one embodiment of the invention.

A variable-nozzle assembly 200 is shown installed in the calibration fixture in FIG. 4, and is shown in isolation in FIG. 5. The variable-nozzle assembly includes a nozzle ring 210 that supports a plurality of vanes 220 each having a vane shaft 222 that extends through a bearing aperture in the nozzle ring, the vanes and bearing apertures being circumferentially spaced about the nozzle ring. An end of each vane shaft 222 projects out from the bearing aperture at the opposite face of the nozzle ring from the vanes. The ends of the vane shafts are rigidly affixed to first ends of respective vane arms 230. Opposite second ends 232 of the vane arms are engaged by a unison ring 240 adjacent the nozzle ring. More particularly, the unison ring's inner diameter defines recesses 242 that receive the ends 232 of the vane arms 230. Rotation of the unison ring about a rotation axis substantially coinciding with the central axis of the nozzle ring causes the vane arms 230 to pivot about pivot axes defined by the bearing apertures in the nozzle ring, thereby rotating the vanes 220 about these axes. This causes the effective flow area through the vanes to be modified.

The variable-nozzle assembly 200 also includes an insert 250 having a tubular part 252 substantially coaxial with the nozzle ring 210 and having a nozzle portion 254 formed as a generally annular flange extending radially outwardly from one end of the tubular part 252. The nozzle portion 254 is spaced axially from the nozzle ring 210, and the vanes 220 are disposed therebetween. The nozzle ring and nozzle portion of the insert thus define a nozzle flow path through which fluid flows, passing through the spaces between the vanes. Accordingly, the setting angle of the vanes affects the flow area through the nozzle flow path, and thereby regulates the flow rate.

The variable-nozzle assembly 200 is installed into the housing 100 with the tubular part 252 of the insert sealingly received in the second portion 108 of the housing passage. A sealing ring 256 is retained in a groove in the outer cylindrical surface of the tubular part 252 for sealingly engaging the inner surface of the housing passage. A ring-shaped flange 260 of the variable-nozzle assembly is inserted into the first portion 106 of the housing passage before the rest of the variable-nozzle assembly is inserted. A radially outer portion of the flange 260 engages an axially facing annular surface 114 of the housing, and a radially inner portion of the flange engages an axially facing surface of the nozzle ring 210. A ring-shaped spring member 270 is inserted into the housing against an axially facing annular surface 116 of larger diameter than the surface 114. Another ring-shaped spring member 280 is inserted against a radially inwardly facing surface of a radially inner portion of the nozzle ring 210. The cover 120 of the fixture is then placed atop the spring members 270 and 280. A radially outer portion of the cover abuts the spring member 270 and compresses it between the cover and the housing surface 116, and a radially outwardly facing surface of a radially inner portion of the cover, which replicates the nose portion of the turbocharger center housing, engages the inner diameter of the spring member 280. The cover is secured to the housing such that these two parts of the fixture are substantially sealed together and contain the variable-nozzle assembly therebetween.

The cover 120 includes an aperture 122 therethrough. The variable-nozzle assembly includes a stop member 290 (FIG. 5) that is received in a receptacle defined in the nozzle ring 210 in such a manner that the stop member is rotatable in the receptacle about its axis. The aperture 122 in the cover is located in alignment with the stop member 290. The stop member 290 in the illustrated embodiment comprises a pin or the like, having a slotted head for receiving a screwdriver or similar tool. The stop member also includes an eccentric cam 292 extending radially out from the shaft of the stop member. The stop member is positioned such that the cam 292 can contact one of the vane arms 230, and such that rotation of the stop member in one direction about its axis causes the cam to push the vane arm and cause it to rotate about the pivot axis defined by the bearing aperture in the nozzle ring associated with the vane arm. This rotation of the vane arm causes the unison ring 240 to be rotated, which in turn causes the other vane arms 230 to rotate in unison with the vane arm in contact with the cam 292. In this manner, all of the vanes are pivoted in unison when the stop member is rotated.

A calibration process for a variable-nozzle assembly using the calibration fixture 20 is now explained. With the variable-nozzle assembly 200 installed in the fixture as described above, a source of fluid (e.g., air) is coupled to the fluid supply passage 112 of the housing 100. The fluid source is operated to supply fluid into the housing at a specified flow rate. The fluid flows from the chamber 110 through the spaces between the vanes 220 and then through the tubular part 252 of the insert 250 and is discharged from the second portion 108 of the passage in the housing.

While the fluid is flowing, the operator inserts a suitable tool through the aperture 122 in the cover 120 and engages it with the stop member 290 in the variable-nozzle assembly. The operator turns the stop member while monitoring the flow rate of the fluid, which can be measured by a suitable flow meter associated with the fluid source. The stop member is turned until the indicated flow rate reaches a predetermined level (e.g., a minimum flow rate, or alternatively a specified quantitative flow rate). The fluid source is then turned off and the cover 120 is removed, and the variable-nozzle assembly 200 is removed from the housing 100.

The stop member 290 is then permanently fixed in the position determined during the calibration process, such as by welding the stop member to the nozzle ring 210 or by press-fitting the stop member (while preventing it from rotating) into a tapering or reduced-diameter portion of the receptacle such that the stop member is immobilized by frictional interference fit.

The variable-nozzle assembly 200 calibrated according to the above-described process is ready for installation into a turbocharger. After such installation, further calibration will not be necessary. The invention thus substantially simplifies and speeds up the overall turbocharger assembly process.

Many modifications and other embodiments of the inventions set forth herein will come to mind to one skilled in the art to which these inventions pertain having the benefit of the teachings presented in the foregoing descriptions and the associated drawings. Although specific terms are employed herein, they are used in a generic and descriptive sense only and not for purposes of limitation.

What is claimed is:

1. A process for calibrating a variable-nozzle assembly for a turbine of a turbocharger prior to installation of the variable-nozzle assembly in the turbocharger, comprising the steps of:

installing the variable-nozzle assembly in a calibration fixture having internal flowpath contours configured to substantially replicate corresponding internal flowpath contours of a turbocharger into which the variable-nozzle assembly is to be installed, the calibration fixture defining a generally annular chamber in fluid communication with a flow path defined in the variable-nozzle assembly, and a fluid supply passage extending from an outer surface of the calibration fixture into the annular chamber;

connecting a fluid source to the fluid supply passage of the fixture and causing a flow of fluid from the fluid source to the fluid supply passage, the fluid then flowing through the flow path of the variable-nozzle assembly; and adjusting a setting angle of vanes of the variable-nozzle assembly while the fluid is flowing through the variable-nozzle assembly to cause the fluid to have a flow rate equal to a predetermined flow rate.

2. The process of claim 1, wherein the variable-nozzle assembly comprises a generally annular nozzle ring defining a plurality of circumferentially spaced bearing apertures therethrough, a plurality of the vanes proximate one face of the nozzle ring and each having a vane shaft extending through a respective one of the bearing apertures such that a distal end of each vane shaft is proximate an opposite face of the nozzle ring, and a plurality of vane arms having first ends respectively affixed to the distal ends of the vane shafts and having opposite second ends engaged by a unison ring that is rotatable relative to the nozzle ring about a central longitudinal axis of the variable-nozzle assembly such that rotation of the unison ring causes the vane arms and the vane shafts to pivot about respective axes thereof so as to rotate the vanes to a different setting angle, the variable-nozzle assembly further comprising an insert spaced from the nozzle ring such that the vanes are disposed between the nozzle ring and a portion of the insert, the insert having a tubular part extending along the longitudinal axis for being received in a turbine housing bore of a turbocharger; and wherein the calibration fixture includes a housing and a cover, the housing defining a central passage extending from a first end at a first face of the housing through to an opposite second end at a second face of the housing, the central passage having a first portion adjacent the first face that is configured to receive the nozzle ring, a second portion sized to receive the tubular part of the insert in a substantially sealed manner, and a third portion disposed generally between the first and second portions to form the generally annular chamber surrounding a central longitudinal axis of the housing, the fluid supply passage being defined in the housing, the cover being configured to engage the housing proximate the first face thereof to substantially close the first end of the central passage.

3. The process of claim 2, wherein the installing step comprises disposing the variable-nozzle assembly in the housing with the tubular part of the insert substantially sealingly received in the second portion of the central passage, and wherein the vane arms of the vanes are in a baseline position when the flow rate equals the predetermined flow rate.

4. The process of claim 2, further comprising the step of affixing a stop member to the nozzle ring, the stop member being structured and arranged to prevent the vane arms from pivoting in one direction past the baseline position, while allowing the vane arms to pivot in an opposite direction away from the baseline position.

5. The process of claim 4, wherein the stop member is engaged in a receptacle defined in the opposite face of the nozzle ring such that the stop member is rotatable about an axis thereof, the stop member having an eccentric cam positioned to engage one of the vane arms such that rotation of the stop member about its axis in one direction causes the cam to urge the vane arm to pivot about the respective vane shaft's axis, the vane arm in turn causing the unison ring to rotate and thereby pivot the other vane arms in unison, and wherein the step of adjusting the setting angle of the vanes comprises rotating the stop member.

6. The process of claim 5, wherein the cover includes an opening therethrough aligned with the stop member, and the step of rotating the stop member comprises passing an end of a tool through the opening in the cover and engaging the tool end with the stop member for rotating the stop member.

7. The process of claim 5, further comprising the step, following the adjusting step, of fixing the stop member in a substantially permanent manner in the position of the stop member that causes the flow rate to equal the predetermined flow rate.

8. The process of claim 2, wherein the housing is provided to have internal surfaces configured to substantially replicate corresponding surfaces of a turbine housing of a turbocharger into which the variable-nozzle assembly is to be installed, and the cover is provided to have internal surfaces configured to substantially replicate corresponding surfaces of a center housing of the turbocharger.

9. A variable-nozzle assembly for a turbocharger, comprising:

a generally annular nozzle ring defining a plurality of circumferentially spaced bearing apertures therethrough;

a plurality of vanes proximate one face of the nozzle ring and each having a vane shaft extending through a respective one of the bearing apertures such that a distal end of each vane shaft is proximate an opposite face of the nozzle ring;

a plurality of vane arms having first ends respectively affixed to the distal ends of the vane shafts and having opposite second ends engaged by a unison ring that is rotatable relative to the nozzle ring about a central longitudinal axis of the variable-nozzle assembly such that rotation of the unison ring causes the vane arms and the vane shafts to pivot about respective axes thereof so as to rotate the vanes to a different setting angle, the variable-nozzle assembly further comprising an insert spaced from the nozzle ring such that the vanes are disposed between the nozzle ring and a portion of the insert, the insert having a tubular part extending along the longitudinal axis for being received in a turbine housing bore of a turbocharger, the variable-nozzle assembly defining a flow path between the nozzle ring and the portion of the insert and through passages between the vanes such that a fluid can flow generally radially inwardly along the flow path and then through the tubular part; and a stop member affixed to the nozzle ring, the stop member being structured and arranged to prevent the vane arms from pivoting in one direction past a baseline position of the vane arms, while allowing the vane arms to pivot in an opposite direction away from the baseline position, wherein the stop member is engaged in a receptacle defined in the opposite face of the nozzle ring such that the stop member is rotatable about an axis thereof, the stop member having an eccentric cam positioned to engage one of the vane arms such that rotation of the stop member about its axis in one direction causes the cam to urge the vane arm to pivot about the respective vane shaft's axis, the vane arm in turn causing the unison ring to rotate and thereby pivot the other vane arms in unison.

* * * * *